United States Patent [19]

Viglione

[11] Patent Number: 4,748,995

[45] Date of Patent: Jun. 7, 1988

[54] TENT FRAME

[75] Inventor: Guiseppe Viglione, Horsley Park, Australia

[73] Assignee: Cornel Paul Nemeth, Duranbah, Australia

[21] Appl. No.: 754,480

[22] Filed: Jul. 12, 1985

[30] Foreign Application Priority Data

Jul. 12, 1984 [AU] Australia ..... PG5967

[51] Int. Cl.[4] ..... E04H 15/48; E04H 15/36

[52] U.S. Cl. ..... 135/109; 135/102

[58] Field of Search ..... 135/900, 901, 102, 103, 135/104, 106, 107, 109

[56] References Cited

U.S. PATENT DOCUMENTS

| | | | |
|---|---|---|---|
| 1,819,490 | 8/1931 | Weiss | 135/102 |
| 2,159,309 | 5/1939 | Betourne | 135/102 |
| 2,792,844 | 5/1957 | Clark | 135/103 X |
| 2,829,659 | 4/1958 | Megenity | 135/109 X |
| 2,832,361 | 4/1958 | Smith | 135/102 |
| 2,864,390 | 12/1958 | Oliver et al. | 135/102 |
| 2,960,993 | 11/1960 | Holmstrom | 135/102 |
| 3,034,523 | 5/1962 | DeShano | 135/900 X |
| 3,256,896 | 6/1966 | Cummins | 135/103 |
| 3,405,721 | 10/1968 | Crosier et al. | 135/102 X |
| 3,675,667 | 7/1972 | Miller | 135/104 X |
| 3,865,123 | 2/1975 | Bracken | 135/102 |
| 3,874,397 | 4/1975 | Oberhaus | 135/104 X |
| 3,960,161 | 1/1976 | Norman | 135/104 |
| 3,990,463 | 11/1976 | Norman | 135/104 |

FOREIGN PATENT DOCUMENTS

| | | | |
|---|---|---|---|
| 2163149 | 12/1971 | Fed. Rep. of Germany . | |
| 2715912 | 4/1977 | Fed. Rep. of Germany . | |
| 8231650 | 6/1983 | Fed. Rep. of Germany . | |
| 1325748 | 3/1963 | France . | |
| 2400596 | 3/1979 | France . | |
| 813749 | 5/1959 | United Kingdom . | |
| 1313155 | 4/1973 | United Kingdom | 135/102 |

*Primary Examiner*—Robert A. Hafer
*Assistant Examiner*—D. Neal Muir
*Attorney, Agent, or Firm*—Ladas & Parry

[57] ABSTRACT

A foldable tent consisting of a frame and a cover and ground sheet permanently fixed thereto, the frame is formed by a plurality of generally U-shaped frame members which have their extremities fixed to pivot assemblies, the frame is foldable by having the legs of the frame members pivotable to a folded nested position.

6 Claims, 4 Drawing Sheets

FIG. 2
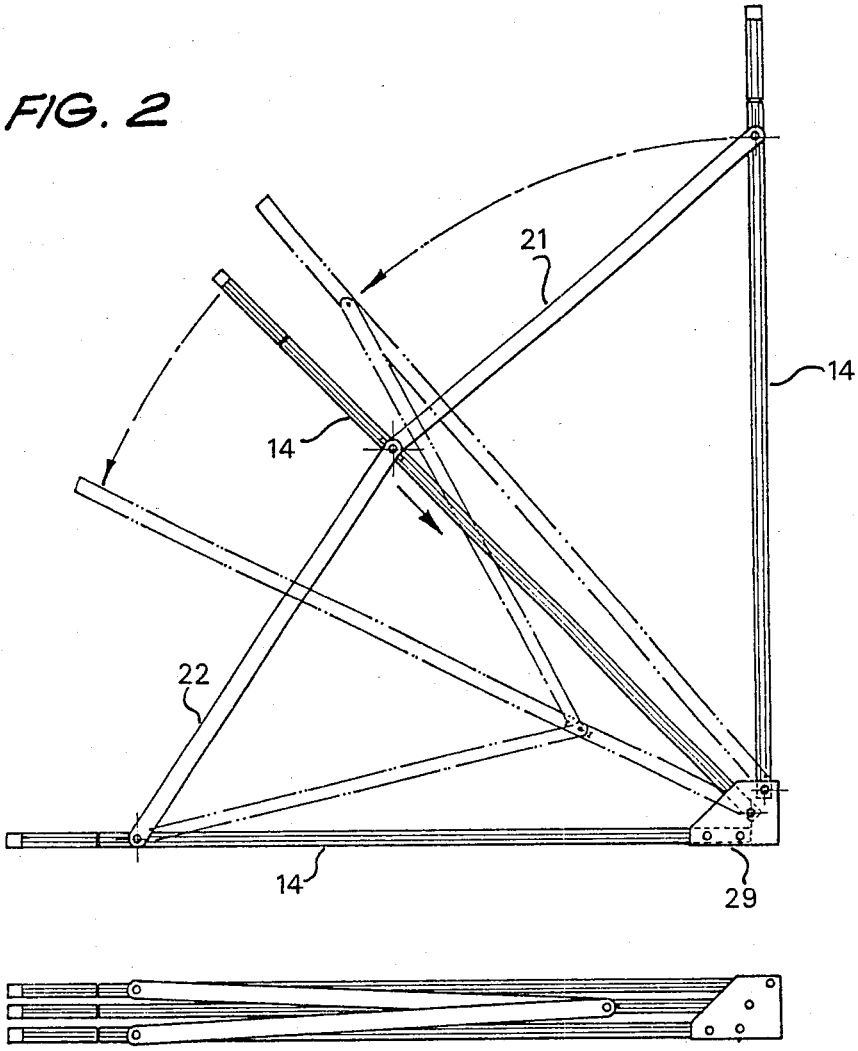
FIG. 3
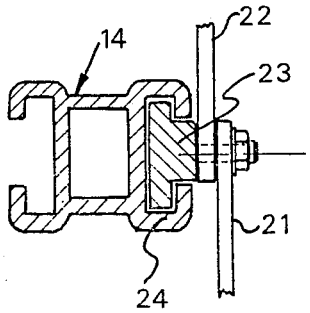
FIG. 4

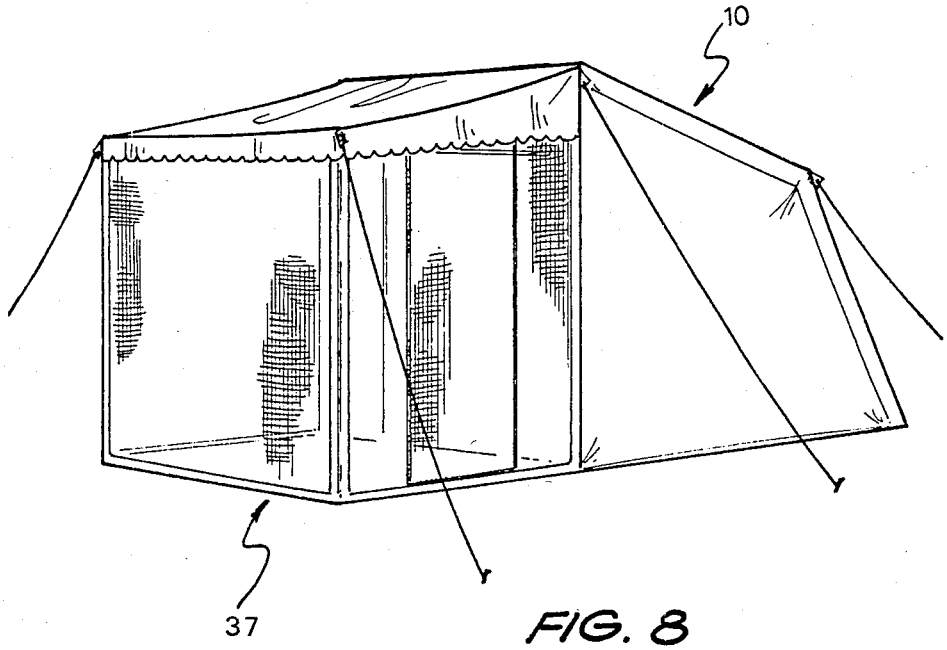
FIG. 8
FIG. 9
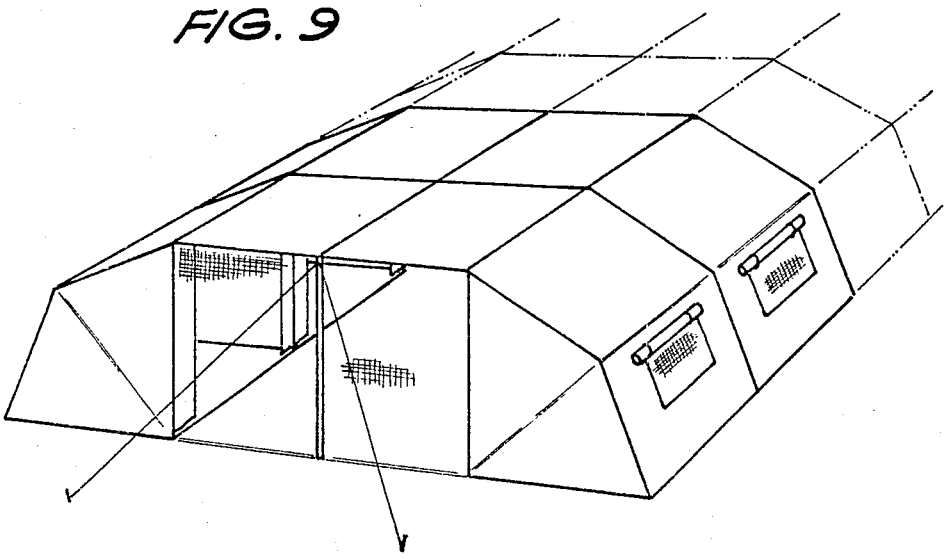

TENT FRAME

The present invention relates to the construction of tent frames and more particularly to the construction of a tent having its sheet material fixed to the frame to facilitate quick and easy erection of a tent.

It is a general disadvantage of known tents that they are generally complex and therefore difficult and time consuming to erect. Additionally, this complex structure adds significantly to the manufacturing costs of the tents.

Several attempts have been made to provide a tent which is both easily erected and of simple construction. The following documents disclose such attempts.

U.S. Pat. No. 2,960,993 discloses a tent again having U-shaped frame members. In order to facilitate folding, each of the frame members is telescopically constructed. In this particular instance, the cover sheet is fixed to the frame. Due to the telescopic nature of the frame members, in order to facilitate folding, the construction of this tent is generally complex and therefore costly. Additionally, the erection is not straightforward and thus requires considerable time for erection.

U.S. Pat. No. 3,405,721 discloses a tent frame, again with each of the main frame members being of generally U-shaped configuration. In this particular instance the cover sheet and ground sheet are applied to the frame once the frame is erected. The frame is not designed to receive the sheet cover in a fixed manner since the cover would hinder folding of the frame due to the positioning of the pivots in the frame. Accordingly, this particular tent has the disadvantage that the frame must be constructed and then the cover applied thereto. This is generally time consuming.

U.S. Pat. No. 3,865,123 discloses a tent with the frame members, again, being of generally U-shaped configuration. In this particular instance, the cover and ground sheet are fixed to the frame tent. However, the ground cover is provided with a "zip" fastener to thereby enable folding of the frame. The inclusion of this fastener and other work required to form the floor cover, add considerably to the overall cost of the tent.

U.S. Pat. No. 1,819,490 describes a frame substantially the same as the frame of U.S. Pat. No. 3,865,123. However, in this particular instance, the sheet covers are applied to the frame once the frame is erected. Accordingly, the erection of this tent is generally time consuming and consists firstly of erecting the frame and then applying the cover thereto. U.S. Pat. No. 2,159,309 discloses a still further frame similar to the frame of U.S. Pat. No. 3,865,123. The cover and ground sheet are fixed to the frame; however, the ground cover is again split to enable folding of the frame. This adds to the cost of the tent.

It is the object of the present invention to overcome or substantially ameliorate the above disadvantages by providing a tent which is easily erected and has a minimum cost of manufacture.

A still further object of the present invention is to provide a tent with the cover and ground sheet fixed to the frame.

There is disclosed herein a foldable tent comprising a frame, and a cover and ground sheet fixed to the frame so as to provide an enclosed living area when said tent is erected, said frame consisting of a plurality of frame members, each of generally U-shaped configuration, so as to each have an elongated base from which there extends two arms, with the arms cooperating to provide two sides of the tent, a pivot assembly for each tent side to which the extremities of the arms of the respective side are attached so that the arms of each member pivot about a first folding axis or parallel first folding axes, said pivotting assemblies enabling pivotting movement of said frame members from a folded position, wherein said members are in an abutted relationship to an erected position wherein said members are angularly spaced about said first axis or axes, brace means extending between said frame members to support same when erected, and wherein one of the frame members provides an end face of the tent, which end face is generally upwardly extending, and each arm is pivotally attached to its base enabling pivotting therebetween about a second folding axis extending generally within the plane of the respective side and normal to the direction of extension of the arm when said tent is erected, with the second axes of the arms of the side being generally co-terminous when the tent is folded, the second axes of one side being spaced further from the pivot assembly of that side than the second axes of the other side relative to its pivot assembly so that the arms of said one side fold against the bases and the arms of the other side are fold against the arms of said one side.

A preferred form of the present invention will now be described by way of example with reference to the accompanying drawings wherein:

FIG. 2 is a schematic side elevation of the tent of FIG. 1;

FIG. 3 is a schematic side elevation of the frame of the tent of FIG. 1 in a partly folded position;

FIG. 4 is a schematic sectioned end elevation of a portion of the bracing employed in the tent of FIG. 1;

FIG. 8 is a schematic perspective view of a modification of the tent of FIG. 1; and FIG. 9 is a schematic perspective view of a series of tents constructed in a similar manner to the tent of FIG. 1.

Figure 1:
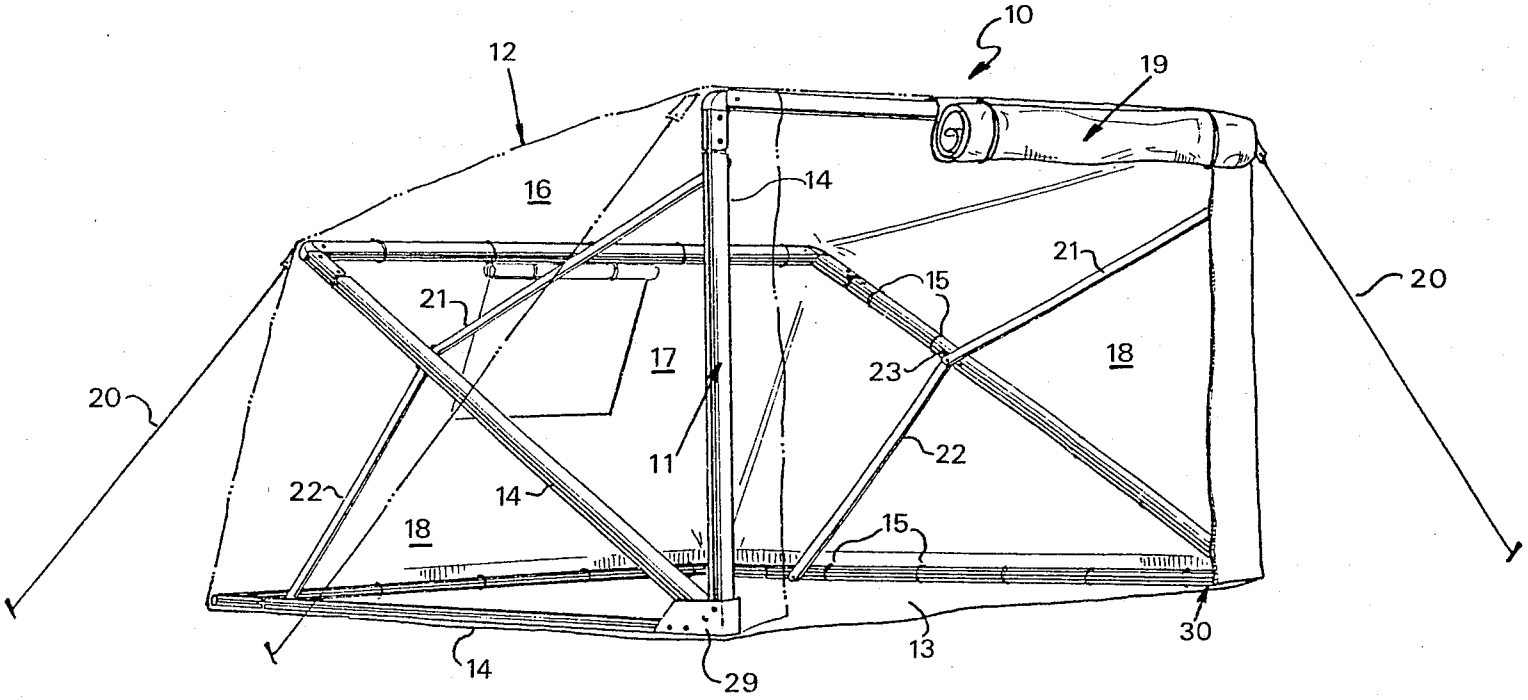
FIG. 1 is a schematic perspective view of a foldable tent.

In FIG. 1 there is schematically depicted a tent 10 having a frame 11 which supports a cover sheet 12 and which rests upon a ground sheet 13. The frame 11 consists of a plurality of frame members 14, each of generally U-shaped configuration. The frame members 14 are formed of metal tubing having a rectangular or square cross-section. The cover sheet 12 and ground sheet 13 are permanently fixed to the frame members 14 by straps 15.

The sheet 12 provides a roof surface 16, a rear wall 17, and two side walls 18. The front wall of the tent 10 is provided with one or more foldable panels 19 which provide access to the interior of the tent 10.

It should be appreciated that the tent 10 is self-supporting and will generally not require anchoring to a ground surface. However, if the weather conditions so require it, the tent 10 could be tied down via lines 20. Still further, if required, the ground sheet 13 could be provided with eyelets adjacent its periphery through which pegs could be driven to further aid in anchoring the tent 10 to a ground surface.

The frame members 14 are held in an erected position by means of braces 21 and 22. One extremity of the two braces 22 is pivotally attached to the frame member 14 resting on the ground surface while one extremity of the brace members 21 is pivotally attached to the frame member 14 which is generally vertically extending. The other two extremities of the braces 21 and 22 are attached to a slide 23, slidably received in a channel 24 defined in the frame member 14.

Figure 7:
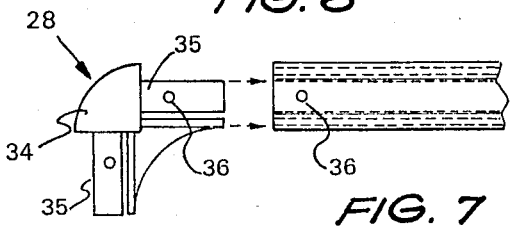
FIG. 7 is a schematic front elevation of a corner assembly of the frame of the tent of FIG. 1.

Each of the frame members 14 is of generally U-shaped configuration so as to have an elongated base 25 from which there extends two arms 26 and 27. Each of the arms 26 and 27 is attached to its associated base 25 by means of a corner construction 28, best seen in FIG. 7. The extremities of the arms 26 are attached to a pivot assembly 29 while the extremities of the arms 27 are pivotally attached to a pivot assembly 30. The arms 26 and 27 are pivotally attached to their associated pivot assembly 29 or 30 so as to be pivotable about the same axis (when the arms 26 and 27 extend generally normal to the base 25) or, alternatively, are pivotable about a plurality of axes which are generally parallel. However, it should be appreciated that the arms 26 and 27 (of each individual frame member 14) pivot about the same axis defined by the associated pivot assemblies 29 and 30. The ground engaging member 14 is preferably fixed to the pivot assemblies 29 and 30.

Figure 5:
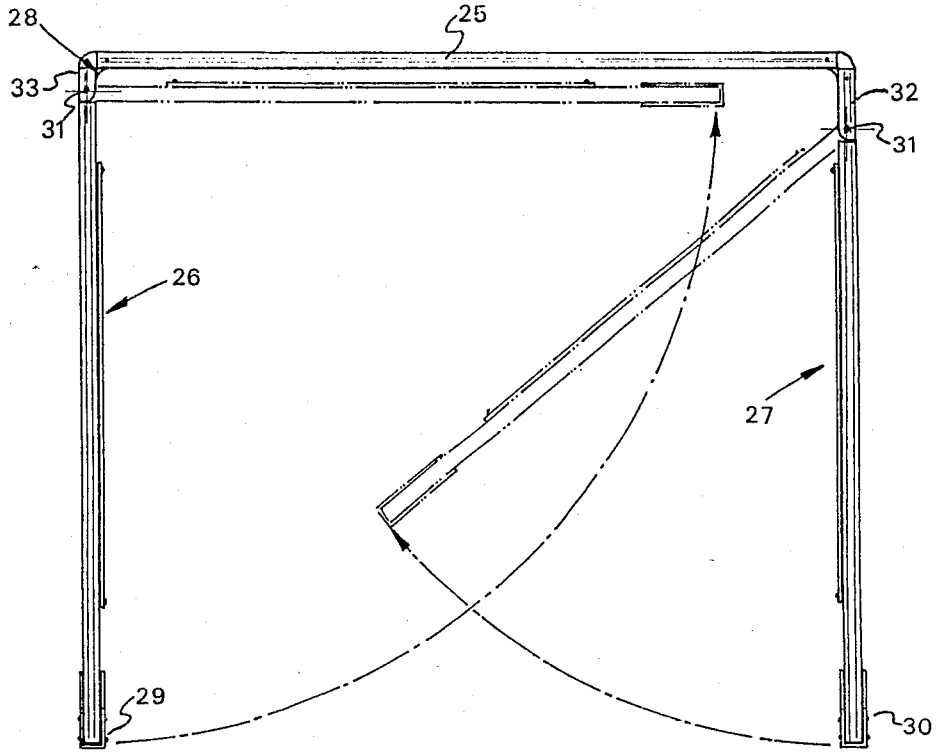
FIG. 5 is a schematic plan view of the frame of the tent of FIG. 2 in a partly folded condition.

Each of the arms 26 and 27 is pivotally attached to its associated base 25 by means of pins 31. The pins 31 define pivot axes normal to the axis or axes defined by the pivot assemblies 29 and 30. It should also be appreciated that the pin 31 of the leg 27 is located closer its associated pivot assembly 30, than the pin 31 of the leg 26 relative to its associated pivot assembly 29. The pin 31 of the leg 27 is joined to the base 25 by a portion 32 which is correspondingly shorter than the portion 33 joining the leg 26 to the base 25. The relative lengths of the portion 32 and 33 enables folding of the legs 26 and 27 to the position shown in FIG. 5, with the cover sheet 12 and ground sheet 13 still attached to the frame 11.

Each corner assembly 28 consists of a corner member 34 having two projections 35 which are telescopically received within the associate members to be joined. Fasteners are then passed through the passages 36 to effect a secure join.

Figure 6:
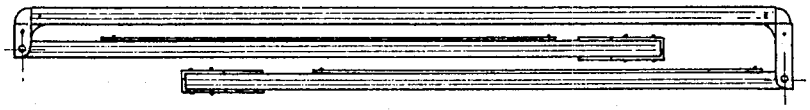
FIG. 6 is a schematic plan view of the frame of the tent of FIG. 2 in a completely folded position.

The abovedescribed tent 10, with its frame 11, cover sheet 12 and ground sheet 13 is easily folded and erected. In order to fold the tent from the erected position, the braces 21 and 22 are pivotted towards the pivot assemblies 29 and 30. Once the frame members 14 have reached the position depicted in FIG. 3, they then can be pivotted in towards the base 25 to arrive at the position depicted in FIG. 5. It should be appreciated that the frame 11 can be positioned in the configuration of FIG. 6 with the cover sheet 12 and ground sheet 13 still attached to the frame 11.

As can be seen from FIG. 8, the tent 10 described above, can be provided with a detachable annex 37 and still further, as depicted in FIG. 9, a plurality of the tents 11 may be arranged in order to provide a tent combination required.

I claim:

1. A foldable tent comprising a frame, and a cover consisting of a roof, at least three sides and ground sheet fixed to the frame so as to provide a generally sealingly enclosed living area when said tent is erected, said frame consisting of a plurality of frame members, each of generally U-shaped configuration, so as to each have an elongated base assembly, consisting of an elongated base member from which there extends generally transverse thereof two base portions one at each end of said base member, from which there extends two arms, with the arms of the frame members cooperating to provide two frame sides, a pivot assembly for each frame side to which the extremities of the arms of the respective side are attached so that the arms of each frame side pivot about a first folding axis, the two first folding axes are parallel and may be colinear, said pivot assemblies enabling pivotting movement of said frame members from a folded position, in which said frame members are in an abutted relationship, to an erected position in which said frame members are angularly spaced about said first folding axes, brace means extending between said frame members to support the frame members in an erected position, said brace means comprising rigid brace members pivotally attached to a frame member and at another end of said brace member attached to another said brace member and a slide, said slide travelling along an intermediate frame member so that when said tent is in said erected position said slide has travelled past an over center position, whereupon one of the frame members provides a generally upwardly extending end face of the tent, each arm being pivotally attached to an adjacent said base member by one of said base portions enabling pivotting therebetween about a second folding axis extending generally within the plane of the respective side and normal to the direction of extension of the arm whereby in the erected position the arms extend away from the base member, with the second axes of the arms of the side being generally co-terminous when the tent is folded, the second axes of one side being spaced further from the pivot assembly of that side than the second axes of the other side relative to its pivot assembly so that the arms of said one side fold against the base members and the arms of the other side are folded against the arms of said one side.

2. The tent of claim 1 wherein each of said frame members are substantially identical and one of said frame members is adapted to rest on a ground surface and is fixed to said pivot assemblies.

3. The tent of claim 2 wherein there are three of said frame members consisting of a floor frame member, an intermediate frame member and an end face member, and each side of said tent has a pair of brace members forming said brace means, with a first of each pair extending between said floor frame member and said intermediate member, and the other of said pair extending between said intermediate member and said end face member.

4. The tent of claim 3 wherein the brace members of each side are each pivotally attached to said frame members and are further slidably attached to said intermediate frame members.

5. The foldable tent of claim 4 wherein said cover and ground sheet are sealingly fixed together.

6. The tent of claim 1 wherein said frame members are formed of tubing of rectangular transverse cross-section.

* * * * *